United States Patent [19]

Bonapace

[11] Patent Number: 4,624,079

[45] Date of Patent: Nov. 25, 1986

[54] KNIFE SHARPENER

[76] Inventor: Mario J. Bonapace, 7396 Broadway, Lemon Grove, Calif. 92045

[21] Appl. No.: 728,339

[22] Filed: Apr. 29, 1985

[51] Int. Cl.[4] ..... B24B 9/04; B24B 7/02

[52] U.S. Cl. ..... 51/214; 51/59 R; 51/173; 51/285; 76/86

[58] Field of Search ..... 51/59 R, 214, 173, 285, 51/354, 158; 76/86, 88, 82.2, 82

[56] References Cited

U.S. PATENT DOCUMENTS

| | | | |
|---|---|---|---|
| 1,365,161 | 1/1921 | Eisenhauer | 51/354 |
| 1,909,743 | 5/1933 | Blanker | 51/354 |
| 2,519,351 | 8/1950 | Calvert | 51/59 R |
| 3,339,313 | 9/1967 | Lindhag | 51/59 R |
| 4,528,777 | 7/1985 | Bernstein et al. | 51/285 |

FOREIGN PATENT DOCUMENTS

| | | | |
|---|---|---|---|
| 30365 | of 1933 | Netherlands | 51/354 |

*Primary Examiner*—Frederick R. Schmidt
*Assistant Examiner*—Bradley I. Vaught
*Attorney, Agent, or Firm*—Charles C. Logan, II

[57] ABSTRACT

A knife sharpener having a pair of abrasive rod members whose bottom ends are mounted on carriages that are reciprocally mounted in channels formed in upstanding block members. The channels travel along an axis that is parallel to the downwardly sloping top surface of the block members. The block members are fixedly attached to the top surface of a base and the mouths of their channels face each other and are aligned on parallel offset axes. The rod members therefore intersect each other at a predetermined angle to form a V at their top into which a knife blade is drawn rearwardly along a horizontal plane to sharpen its edges. Each of the carriages has one of its ends fixedly attached to a spring whose opposite end is fixedly held in position. The downward force of the knife blade as it is being sharpened causes the rod members on the respective carriages to travel downwardly toward each other and when the pressure is released the springs will return them to their initial unloaded positions.

6 Claims, 5 Drawing Figures

KNIFE SHARPENER

BACKGROUND OF THE INVENTION

The invention relates to sharpening devices and more particularly to a device adapted to sharpen the cutting edges of knifes and other articles of cutlery.

Persons such as butchers who employ professional quality knives in their employment require that their knives have a precise cutting edge on them at all times. The major beveled surface of the knife blade is sharpened by a professional knife sharpener. For the cutting tip of the blade however, the butcher generally has his own knife sharpening device which he uses periodically. It is this type of device which applicant has designed.

A prior art knife sharpening device is illustrated in the Johnson U.S. Pat. No. 1,041,631. It is hand held and it uses a pair of abrasive members having a flat surface mounted on arms that are pivotable about their top ends. A knife is drawn across the V formed by the adjacent abrasive members and downward pressure causes the arms to pivot laterally.

Another prior art type sharpening device is illustrated in the Eisenhauer U.S. Pat. No. 1,365,161. It also uses flat surfaced abrasive members which are oriented angularly in opposite directions to form a V therebetween. A knife is drawn through this V in a similar fashion to that explained previously.

The Barsch U.S. Pat. No. 2,124,646 is directed to a knife sharpening device whose abrasive members have an arcuate surface and these abrasive members are mounted on holding elements that are pivotable about a point intermediate their length.

The Lambert U.S. Pat. No. 2,398,711 is directed to a knife sharpening device having its one abrasive member fixedly mounted and its other abrasive member adjustably mounted. A more complicated structure is illustrated in the Blankner knife sharpening device in U.S. Pat. No. 1,909,743.

It is an object of the invention to provide a novel knife sharpening device that is economical to manufacture and market.

It is also an object of the invention to provide a novel knife sharpening device that utilizes rods formed from abrasive material.

It is an additional object of the invention to provide a novel knife sharpening device that provides structure for adjusting the tension on the springs attached to the carriages which support the abrasive rod members.

It is a further object of the invention to provide a novel knife sharpening device that has structure for rotatably adjusting the abrasive rod members so that their entire surface area can be utilized.

SUMMARY OF THE INVENTION

Applicant's novel knife sharpening device has a pair of upstanding block members mounted on a base. The block members each have a downwardly sloping top surface and each has a channel therein axially aligned with its top surface. The mouth of these channels exit the front wall of the respective block members and they are positioned to face each other and are aligned on parallel offset axes. A carriage is mounted in each of the respective channels and an abrasive rod member is attached to the top of the carriage and it extends upwardly at a predetermined angle therefrom. Spring members have there opposite ends attached to the respective carriages and also to a screw secured to the respective block members.

In order to sharpen a knife, the blade thereof is inserted into the V formed by the intersecting abrasive rod members and drawn backward and forward thereover while applying a downward pressure. This causes the respective carrage members to travel downwardly in their channels while the edge of the knife is being sharpened between the two respective rod members. When the downward pressure is relieved therefrom, the springs will cause the carriages to retun to their initial position. Periodically the abrasive rod member may be roatated to use all of their circumferential surface by releasing the set screw member at their bottoms and rotating the abrasive rod members accordingly after which the set screw is tightened again.

DESCRIPTION OF THE PREFERRED EMBODIMENT

Figure 1:
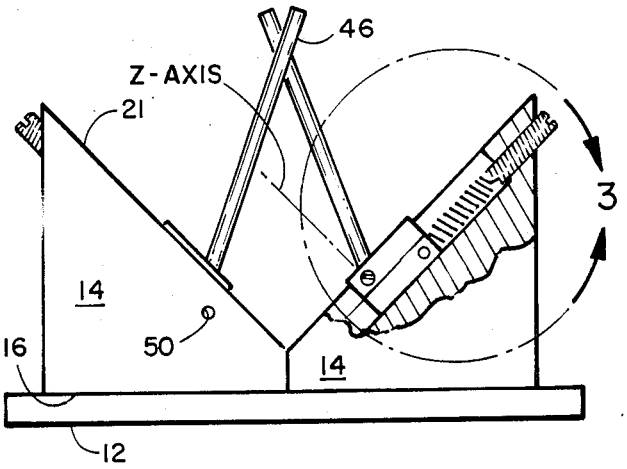
FIG. 1 is a side elevation view of Applicant's novel knife sharpening device.
Figure 3:
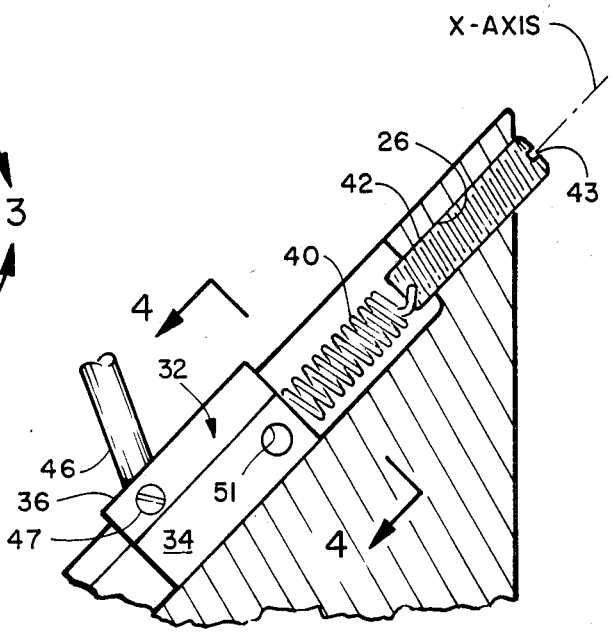
FIG. 3 is an enlarged side elevation view taken along circular line 3.
Figure 2:
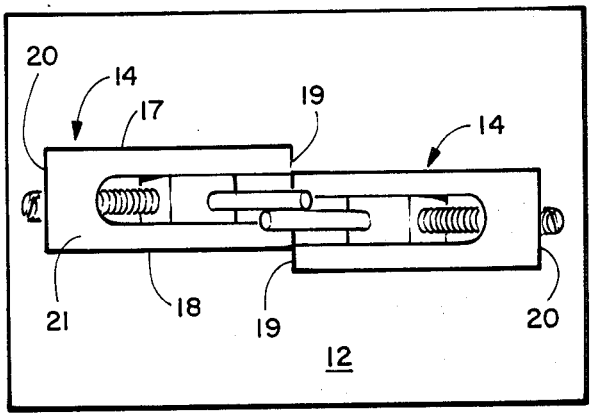
FIG. 2 is a top plan view of Applicant's novel knife sharpening device.
Figure 4:
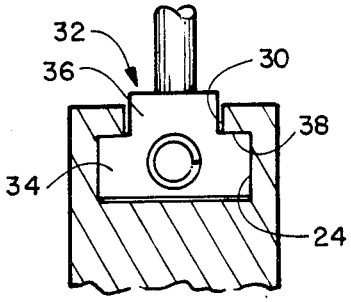
FIG. 4 is a cross sectional view taken along lines 4—4 of FIG. 3.
Figure 5:
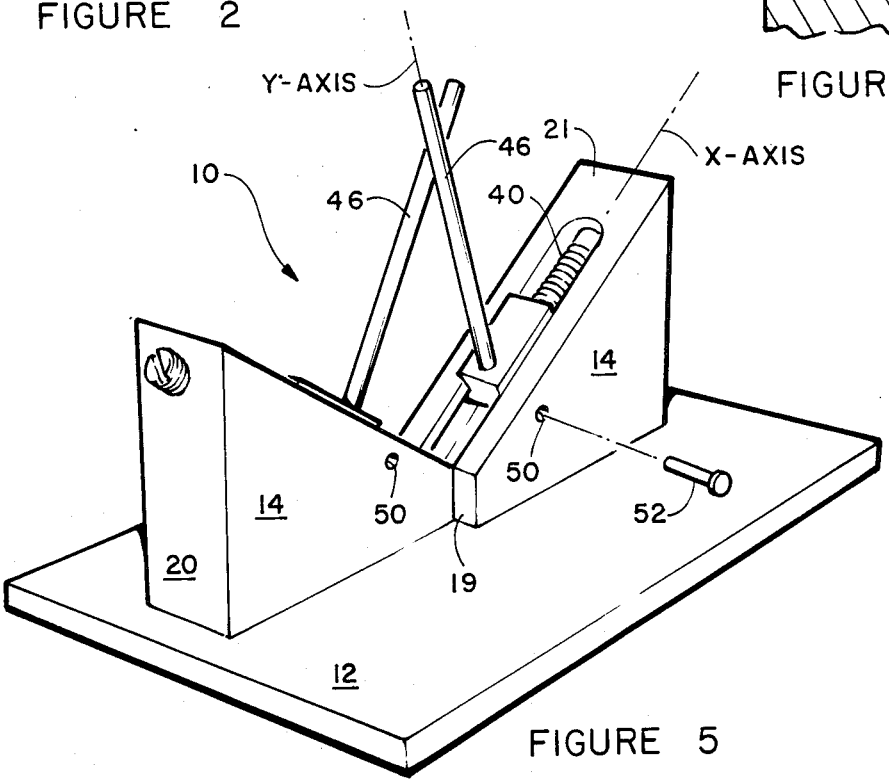
FIG. 5 is a perspective view of Applicant's novel knife sharpening device.

Applicant's novel knife sharpening device will be described by referring to FIGS. 1–5 of the drawings. The knife sharpening device is generally designated numeral 10.

Knife sharpening device 10 has a base 12 having a pair of block members 14 fixedly mounted thereon. Each of the block members 14 has a bottom wall 16, side walls 17 and 18, front wall 19, a rear wall 20, and a downwardly sloping top wall 21.

Since the block members 14 are identical, only the structure of one of them will be described. A channel 24 is formed adjacent top wall 21 and it extends along an x-axis. The bottom end of channel 24 has its mouth formed in front wall 19. The top end of channel 24 communicates with a threaded bore hole 26 that exits through rear wall 20. Inclined top surface 21 has a slot 30 in communication with channel 24 and a carriage 32 is reciprocally mounted within channel 24.

Carriage 32 is elongated and has a body portion 34 and a neck portion 36. Carriage 32 cannot be pulled out of slot 30 due to a portion of its structure which is captured by shoulder 38 of the channel 24. A spring 40 has its bottom end rigidly attached to carriage 32 and its top end rigidly attached to adjustment screw 42 having a slot 43 in its external end.

Rod member 46 has its bottom end inserted into an aperture within the top surface of carriage 32. A set screw 47 extends laterally into that aperture and it may be loosened and tightened in order to rotate the abrasive rod member 46 thereby utilizing all of its abrasive surface. The rod member may be made of an abrasive material such as sand blasted, chromized hardened steel. Access to set screws 47 is through apertures 50 when carriage 32 is pushed downwardly a sufficient distance to align with the set screws. By pushing the carriages farther downwardly apertures 50 align with apertures 51 in neck portion 36 and by inserting a pin 52 through the aligned apertures 50 and 51 the carriages can be locked in a bottom position so that the rods 46 would remain stationary during the knife sharpening operation. Rod members 46 extend along a y-axis that makes an angle of approximately 12.5 degrees with the z-axis.

What is claimed is:

1. A knife sharpener comprising:

a base;

a pair of block members each having substantially the same predetermined external configuration, each of said block members having a bottom wall, laterally spaced side walls, a front wall, a rear wall, and a top wall that slopes downwardly from rear to front at a predetermined angle;

each of said block members having a channel that extends for a predetermined distance, the mouth of said channel being in said front wall, said channel having an axis parallel to the top surface of the top wall, a slot is formed in the top surface of said top wall that communicates with said channel;

said block members being fixedly attached to the top surface of said base, the mouths of said channels facing each other and being aligned on parallel offset axes;

a carriage slideably mounted in each of said channels, each said carriage having a neck portion that extends upwardly through said slot in a respective block member, rod members formed of abrasive material having said rod members bottom end attached to said neck portion and said rod members extend upwardly at the predetermined angle with respect to said top wall; and a pair of spring members each of which is mounted in respective channels of said block members with one of said spring members ends attached to said carriage and said spring members opposite end attached to said block member.

2. A knife sharpener as recited in claim 1 further comprising means for adjusting the tension on each of said spring members.

3. A knife sharpener as recited in claim 2 wherein said means for adjusting the tension on each of said spring members comprises an adjustment screw having one end fixedly attached to one end of said spring members, said adjustment screw being mounted in a threaded bore hole whose opposite ends are in communication with said channel and said rear wall.

4. A knife sharpener as recited in claim 1 further comprising means for rotationally adjusting said rod members.

5. A knife sharpener as recited in claim 1 wherein said rod members intersect each other at substantially a 25 degree angle.

6. A knife sharpener as recited in claim 1 wherein said rod members are formed from sand blasted, chromized hardened steel.

* * * * *